US006059183A

United States Patent [19]

Hosterman

[11] Patent Number: 6,059,183

[45] **Date of Patent: *May 9, 2000**

[54] VACUUM COIN COLLECTION APPARATUS WITH A REMOTE VACUUM

[76] Inventor: Douglas G. Hosterman, 1254 Fox Ave., Paris, Ohio 44669

[ * ] Notice: This patent is subject to a terminal disclaimer.

[21] Appl. No.: 09/210,362

[22] Filed: Dec. 11, 1998

Related U.S. Application Data

[63] Continuation of application No. 08/880,795, Jun. 23, 1997, Pat. No. 5,941,454.

[51] Int. Cl.[7] ..... G07B 15/00

[52] U.S. Cl. ..... 232/16; 232/1 R; 232/1 D

[58] Field of Search ..... 232/1 R, 16, 1 D, 232/43.1, 43.2, 43.3, 44; 406/106, 127, 191, 192

[56] References Cited

U.S. PATENT DOCUMENTS

| | | | |
|---|---|---|---|
| 2,003,257 | 5/1935 | Fageol et al. . | |
| 3,419,209 | 12/1968 | Munn . | |
| 3,979,054 | 9/1976 | Graham | 232/16 X |
| 4,131,318 | 12/1978 | Deem | 232/1 R X |
| 4,757,941 | 7/1988 | Hosterman et al. | 232/16 |
| 5,284,388 | 2/1994 | Volk et al. . | |

*Primary Examiner*—Terry Lee Melius
*Assistant Examiner*—William L. Miller
*Attorney, Agent, or Firm*—Sand & Sebolt

[57] ABSTRACT

A coin collection apparatus for use with self-service car washing equipment includes a coin meter located in each of one or more car wash bays, a coin collection box located remote therefrom which is inaccessible to the public, and a vacuum providing device remote from both the coin meters and the coin collection box. A conduit extends generally between each of the coin meters and collection box. A vacuum supply intersects each of these conduits along the mid-section of the conduit between the coin meter and the coin collection box. A pump motor is remote from the coin meter, coin collection box, and conduit therebetween, and applies a vacuum to the vacuum supply for conveying coins deposited in the meter toward the collection box. The vacuum supply intersects the conduit at such an acute angle that, although the air is suctioned toward the pump motor, the coins continue along the path of the conduit as the coins cannot make the acute turn. A deceleration coating such as a rubber coating, jog, bend and/or elbow in the conduit just downstream from the vacuum supply intersection serves to decelerate the coins and cause the coins to fall downward into a check valve which is momentarily opened by the coin weight to allow the coin to pass into the coin collection box. A switch integrated with the coin meter activates the vacuum upon insertion of the first coin.

12 Claims, 5 Drawing Sheets

VACUUM COIN COLLECTION APPARATUS WITH A REMOTE VACUUM

CROSS REFERENCE TO RELATED APPLICATIONS

This application is a continuation application of application Ser. No. 08/880,795 filed Jun. 23, 1997, now U.S. Pat. No. 5,941,454 the disclosures of which are incorporated herein by reference.

BACKGROUND OF THE INVENTION

TECHNICAL FIELD

The invention relates to the pneumatic conveying of articles and in particular to the pneumatic conveying of coins from a meter in a car wash bay into a secure collection box. More particularly, the invention relates to such a coin collection apparatus in which the insertion of a coin into a coin box in any one of the wash bays actuates a remote vacuum pump to draw that coin and any coins that follow within a preselected time from the meter into the remote collection box where the remote vacuum pump is positioned to provide a vacuum between the meter and the collection box that sufficiently accelerates the coins such that the coins continue to the collection box even though the vacuum does not continue all the way to and into the collection box.

BACKGROUND INFORMATION

Self-service car cleaning businesses have increased in popularity in recent years due to several factors. One such factor is the desire of vehicle owners to wash, polish and otherwise clean their cars, trucks, vans, etc. more easily, quickly and efficiently than is possible by traditional hand-cleaning methods. Also, many self-serve car wash locations provide 24-hour service 365 days per year. Furthermore, many self-serve car wash locations provide cleaning functions in addition to the wash, rinse and wax cycles commonly found at most locations. These additional functions include tire and engine cleaning, underbody spray, etc., which procedures are too difficult or inconvenient for many vehicle owners to perform at their homes. Most importantly, the self-serve car wash provides a basic car washing service to those individuals who do not have the means available to them at their dwellings to adequately clean their cars, such as an outdoor spigot and hose or a sheltered place such as a garage for cleaning the vehicle during inclement weather. Apartment dwellers are the most common example of individuals with such deficiencies.

The typical self-service car wash includes a plurality of car wash bays, each having its own car washing equipment therein. Such equipment usually consists of a wand or other similar device capable of performing some or all of the above-mentioned car cleaning procedures. The wand is usually actuated by a customer by depositing a predetermined amount of coins into a meter located in the wash bay and then manually moving a dial on the meter to various car cleaning functions listed on the face thereof.

Most self-serve car washes are unattended and are located on or adjacent to busy thoroughfares in order to attract the optimum number of customers. During peak traffic periods, large amounts of money are collected in the coin meters. Unfortunately, however, such exposure also attracts thieves intent on stealing the money contained in the coin meters. A thief can quickly break into the meters and make off with the proceeds contained therein. The owner or operator of the car wash can reduce his losses from such thievery by frequently retrieving the money from the meters, but repeated trips to the car wash are time-consuming and often impractical. Thus, the only alternative solution to this problem is to devise a way to automatically remove the coins from the meters and transport them to a secured area for safekeeping until the coins can be retrieved. One way to achieve such automatic removal is by pneumatically conveying the coins from the meters to a secured area by use of either a pump or blower motor.

Several known prior art pneumatic conveying apparatus are shown in U.S. Pat. Nos. 2,003,257; 3,419,209; and 3,509,911. However, the apparatus shown in these patents must either be actuated by an operator, or if user actuated, the pneumatic conveying means is always running which is costly and inefficient.

One such vacuum coin collection apparatus is disclosed in U.S. Pat. No. 4,131,318. There are significant disadvantages in this U.S. Pat. No. 4,131,318 coin collection apparatus. First, the apparatus shown in the U.S. Pat. No. 4,131,318 utilizes complicated timing mechanisms to periodically actuate a vacuum motor and solenoids whereby coins are periodically conveyed from each coil meter located in separate carwash bays and into a single remote collection chamber. The timing mechanisms actuate the vacuum motor whether or not coins are presently in the coin meter. Furthermore, the apparatus of the type shown in the U.S. Pat. No. 4,131,318 does not remove the coins from the meters immediately upon their deposit. Thus, the possibility exists that the coins still could be pilfered from the meters if a thief strikes between coin removal cycles for a particular meter.

Accordingly the need existed for an improved, user-actuated vacuum coin collection apparatus, particularly for use in connection with self-service car washing equipment. The need also existed for an improved coin collection apparatus in which coins are removed from the meters immediately upon their deposit therein; in which the motor utilized to convey the coins to a secure area operates only when coins are present in the meters; and in which the apparatus is economical to manufacture, is easily installed in new or existing self-service car wash bays, and is simple and reliable in its construction and operation to avoid excessive "downtime" and increased maintenance and repair costs.

In response, the vacuum coin collection apparatus as disclosed in U.S. Pat. No. 4,757,941 was introduced. This apparatus provides for immediate and automatic conveyance of coins from meters located in individual car wash bays to a secured and remote area immediately upon movement of the switch after the depositing of the coins in the meters thereby preventing theft of coins therefrom. This coin collection apparatus is user actuated whereby deposit of a predetermined amount of coins into the coin meter followed by manual actuation of a switch to a selected one of the several car washing actuation positions causes the vacuum within or adjacent to the collection apparatus to convey the deposited coins from the meter to the remote secure collection box. The motor in this improved apparatus only runs when the coins are deposited in the meters. This improved vacuum coin collection apparatus was a simple and reliable construction in comparison to the prior art systems. Furthermore, since the coins were removed from the meters almost immediately after their deposit (at switch actuation), the risk that the coins could be pilfered from the meters, if a thief struck the coin meter, has been eliminated.

However, even the vacuum coin collection apparatus disclosed in U.S. Pat. No. 4,757,941 has several significant disadvantages. First, the apparatus requires that the vacuum motor be within or adjacent to the collection box. This results in an overall collection unit that is of a larger size than needed. Furthermore, the collection box has an additional opening therein for the vacuum motor so as to supply an additional entry point for a thief. Also, the collection box is typically positioned in a secure place which may not have much clearance therearound thereby making it difficult, if not impossible, to repair or replace the vacuum motor. In addition, the single vacuum motor within the collection box supplies one vacuum to the all of the conduits and coin meters thus requiring a larger vacuum pump and needless vacuum throughout many parts of the system. Finally, vacuuming was prompted by switch actuation which could not occur until a full and complete deposit of generally several coins, all of which required a vacuum sufficient enough to suction all of the deposited coins at once from a resting position within the meter. Accordingly, the need exists for an improved vacuum coin collection apparatus.

SUMMARY OF THE INVENTION

Objectives of the invention include providing an improved coin collection apparatus for use with self-service car washing equipment which provides for automatic conveyance of coins from meters located in individual car wash bays to a secured remote area immediately upon deposit of coins, and particularly the first coin, into the meters to prevent theft of the coins therefrom.

Another objective of the invention is to provide an improved coin collection apparatus which is user-actuated, whereby upon deposit of a first of a predetermined amount of coins into the coin meter, a motor is actuated which applies a vacuum to a conduit and conveys the deposited coins from the meter and into a remote secure collection box. A further and related objective is to provide such an apparatus in which the motor runs only when coins are deposited in the meters. An even further and related objective is to provide such an apparatus where an optical or mechanical sensor senses the deposition of the first coin and activates the motor.

A still further objective of the invention is to provide an improved coin collection apparatus which is reliable and simple in its construction and operation, and which can be easily installed in either an existing or new self-service car wash facility.

A further and related objective of the invention is to separate the vacuum motor from the coin collection box thereby reducing the size and weight of the box and making any servicing of the vacuum motor significantly easier by allowing for its placement just about anywhere in between the coin meters and the coin collection box.

Still another objective of the invention is to provide an improved coin collection apparatus which supplies the necessary coin suctioning without requiring a vacuum motor at the end of the conduit, between the coin meters and the coin collection box, or within or adjacent to the coin collection box.

A further and related objective of the invention is to position the vacuum motor remote to any of the coin meters, the conduit, and the collection box, whereby the vacuum motor merely is in fluid connection with the coin meters and/or the conduit thereby providing a simple coin collection apparatus in which any repairs or replacements to the vacuum motor are easy to perform, easy to access, and do not involve the coin meters, conduit, or collection box.

A further and also related objective of the invention is to position the vacuum motor away from the secure and generally enclosed area that the coin collection box is stored in whereby the vacuum motor may be placed in a more open environment whereby access thereto and cooling thereof is provided.

Still yet another objective of the invention is to provide an improved coin collection apparatus where a vacuum is provided in the conduit between the coin meters and the coin collection box, but the coins vacuumed or suctioned through the conduit do not interact with the vacuum motor.

A further and related objective of the invention is to provide an improved coin collection apparatus in which the conduit has a "Y", in which the base is the outlet connected to the coin collection box while the first branch is an inlet connected to one or more of the coin meters and the second branch is a vacuum supply connected to the vacuum motor where the vacuum supply entrance is at an acute angle with the inlet or first branch such that coins accelerated within the first branch cannot enter the vacuum supply and instead continue on their path into the outlet.

An even further objective of the invention is to provide an improved coin collection apparatus which includes a deceleration means such as a rubber coating, jog, bend and/or elbow downstream from the "Y", that is, within the conduit between the vacuum supply and the coin collection box, such that the coins when accelerated from the meter box through the conduit strike the elbow and are thereby slowed down for entrance into the coin collection box.

A further and related objective of the invention is to provide an improved coin collection apparatus in which the jog, bend or elbow has a special coating for easing the collision of the coins into the elbow.

Still yet another objective of the invention is to provide an improved coin collection apparatus in which a check valve is installed in between the intersection of the vacuum supply with the conduit and the coin collection box such that a vacuum is produced within the conduit in between the coin meters and the vacuum supply so as to accelerate coins deposited in the coin meters toward the vacuum supply intersection point. A related objective is to provide such a check valve to assure proper vacuuming between the coin meter and "Y" by maintaining a seal between the "Y" and coin collection box. A further related objective so to provide a check valve in the conduit of each coin meter such that a vacuum only needs to be created within the one conduit between the coin meter and the collection box rather than throughout other conduits connected to other coin meters.

These objectives and advantages are obtained by the improved vacuum coin collection apparatus of the invention, the general nature of which may be stated as including, a coin collection apparatus for use with self-service car washing equipment, including:

(a) a coin meter located at a car wash bay;

(b) a coin collection box formed with a coin-receiving chamber located remote from the car wash bay;

(c) a coin passage extending generally between the coin meter and coin collection box; and (d) means for applying a vacuum to the conduit for conveying a coin deposited in the coin meter into the collection chamber, the means being remotely located from both the coin meter and the coin collection box.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
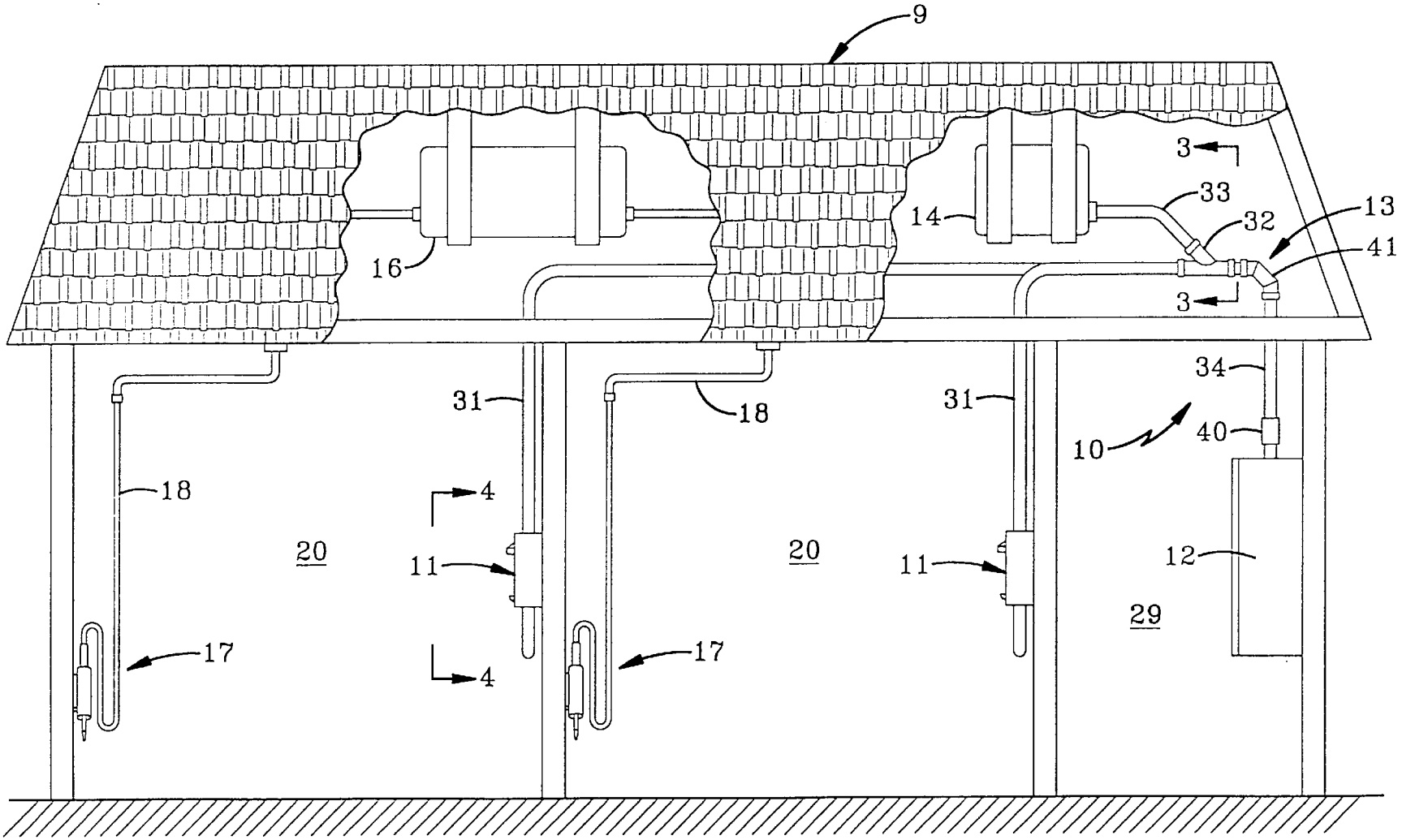
FIG. 1 is a fragmentary perspective view with portions broken away of the vacuum coin collection apparatus of the present invention, installed in a self-service car wash.

The improved vacuum coin collection apparatus of the invention is indicated generally at 10, and is shown particularly in FIG. 1. Vacuum coin collection apparatus 10 is housed within a car wash structure 9 as shown in FIG. 1. Vacuum coin collection apparatus 10 includes one or more coin meters 11, a coin collection box indicated generally at 12, an optional vault (not shown) which is selectively useable for more securely housing the collection box, a coin passage system 13 including conduits from conveying coins 15 where the system 13 extends generally between the coin meter and collection box, one or more pump motors 14 for applying a vacuum to the conduit for conveying coins 15 deposited in any of the coin meters 11 to the collection box 12, and one or more fluids pumps 16 for providing water (soap, or other liquids) to washing equipment 17 via conduits 18.

A typical self-service car wash includes a plurality of car wash bays 20 (FIG. 1), each of which may be equipped with one of the improved vacuum coin collection apparatus of the present invention. However, only one of the coin collection apparatus will be described in detail herein, since the structure and functions of each apparatus is similar.

Figure 4:
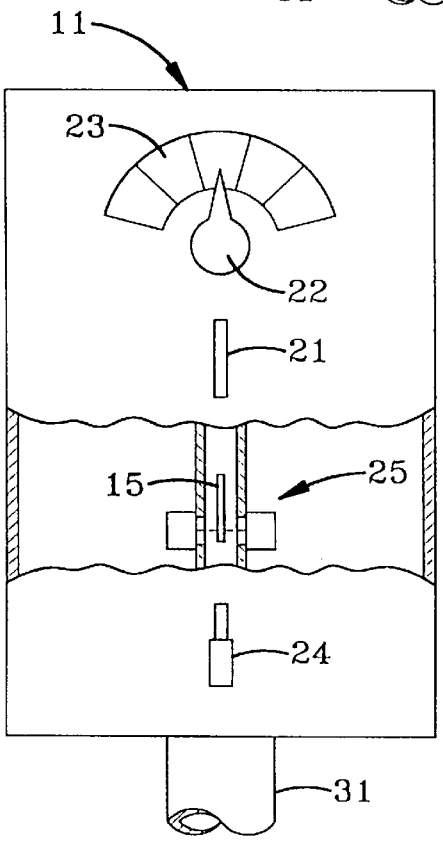
FIG. 4 is a front partial fragmentary view of the coin collection box with an optical coin sensor.

Coin meter 11 of collection apparatus 10 is mounted in each one of the wash bays 20 of a self-service car wash installation (FIG. 1). The specific details of each coin meter 11 are for the most part conventional and, therefore, are described only briefly herein. Coin meter 11 has a coin deposit slot 21 formed therein and a selection dial 22 rotatably mounted thereon (FIG. 4). A user of the car wash inserts a predetermined amount of coins into slot 21 depending on the cleaning function or functions desired. He or she then selects the desired cleaning function by rotating dial 22 to the appropriate position, as indicated on a face 23 of coin meter 11. Preferably, the available functions include presoak, wash, foaming brush, rinse, tire clean, engine clean, and hot wax, though more functions can be included or some excluded without affecting the concept of the invention. An optional button 24 may also be available to actuate the available functions as noted above, however, in the most preferred embodiment the selection dial 21 will serve this function once sufficient coins have been inserted into the slot 21.

Figure 5:
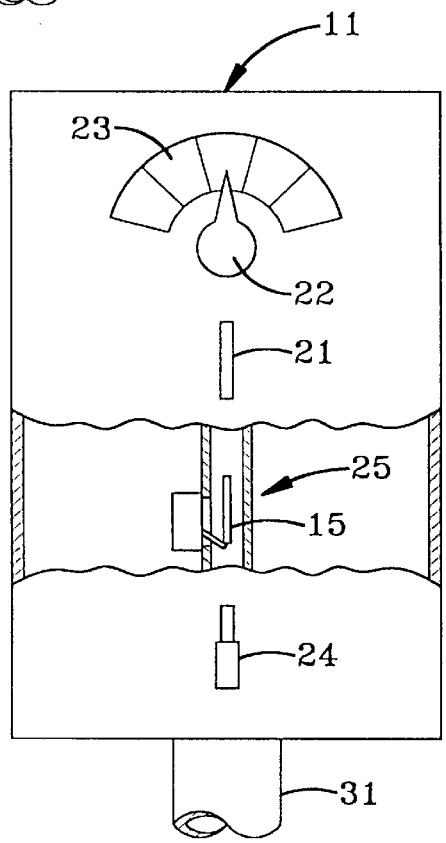
FIG. 5 is a front partial fragmentary view of the coin collection box with a mechanical coin sensor.

In accordance with one of the features of the invention, each of the above-described conventional coin meters 11 may include a novel sensing mechanism 25 just inside of slot 21. Sensing mechanism 25 may be an optical sensor (FIG. 4), a mechanical sensor (FIG. 5), or any other sensing mechanism capable of determining that a coin has passed into slot 21. In one optical sensing mechanism as is shown in FIG. 4, a transmitter is positioned on one side just inside of slot 21 with a receiver or a reflector positioned opposite thereof across the slot such that any break in the optical or similar media extending from the transmitter to the receiver or reflector (and/or back therefrom) indicates a coin has passed through slot 21. It is also possible that such sensor may be able to sense the passing of a metal coin or a specific density, material, or other property of a token. In another embodiment as is shown in FIG. 5, sensor 25 is instead a mechanical sensor with a lever or similar switch that is activated by the passing of a coin through slot 21. Sensor 25 is then electrically connected to pump motor 14 whereby the sensing of the first coin to pass through slot 21 causes pump motor 14 to create a vacuum thereby suctioning coin 15 from slot 21 all the way to collection box 12 as is described in more detail below.

The coin collection box 12 is housed in a secure room 29 (FIG. 1) or otherwise secure area such as underground, where the secure area of the carwash is remote from bays 20 and inaccessible to the public. The coin collection box 12 is preferably of a rectangular-shape and formed of a sturdy metal. This collection box 12 is often either designed to be of a vault-like nature, or is installed within a vault that may house one or more collection boxes.

In accordance with one the main features of the invention, pump motor 14 of collection apparatus 10 is mounted remote from both the coin meters 11 and the coin collection box 12. Such remote location may be significantly spaced apart from the collection box or adjacent to but not within the collection box as has been necessary in the past. Various locations include in the ceiling of the car wash, on the walls of the car wash, or underground of the car wash, but in every case not within the collection box.

Pump motor 14 communicates with each of the coin boxes 11 such that, as described above, the insertion of a first coin into a slot 21 in any of the coin meters 11 results in the actuation of pump motor 14 so as to apply a vacuum to a substantial portion of the conduit or coin passage 13 extending from that particular coin meter 11 and the coin collection box 12. Specifically, the motor is operatively connected by an electrical circuit to the above-referenced sensors 25 within and integrated to the coin meters 11 and controlled by the passage of the first coin into each coin meter 11.

System or conduit 13 includes a first conduit 31 extending from the coin meter 11 to a "Y" 32 ("Y" is loosely used to mean any three way fitting or connector including but not limited to geometric "Y" and "T" fittings), a second conduit 33 extending from the pump motor 14 to "Y" 32, and a third conduit 34 extending from the "Y" 32 to collection box 12. This design allows the pump motor 14 to supply a vacuum to the conduit for conveying coins deposited into the coin meter from the coin meter to the collection box. At the same time, this design allows the pump motor 14 to be remotely located away from both the coin meters 11 and the coin collection box 12.

In accordance with one of the main features of the invention, "Y" 32 is designed to create a vacuum from coin meter 11 to almost coin collection box 12 by supplying the vacuum midway therebetween at an acute angle as is shown in FIG. 1. In conjunction with this main feature, another critical feature is check valve 40 which is positioned in conduit 13 at approximately the entrance to coin collection box 12. Check valve 40 may be any type of check valve through which coins can pass in one direction (in this case, from third conduit 34 to collection box 12, but not vice-versa), and which functions to fluidly seal third conduit 34 when pump motor 14 is actuated thereby allowing a vacuum to form between coin meter 11 and pump motor 14 via first conduit 31, "Y" 32, and second conduit 33. This check valve is critical because it seals off the third conduit so a vacuum form from the first to the second conduit since the collection box often is not a sealed device and since in many cases multiple third conduits from other coin meters are emptying into the collection box thereby also providing unsealed passages.

Figure 2:
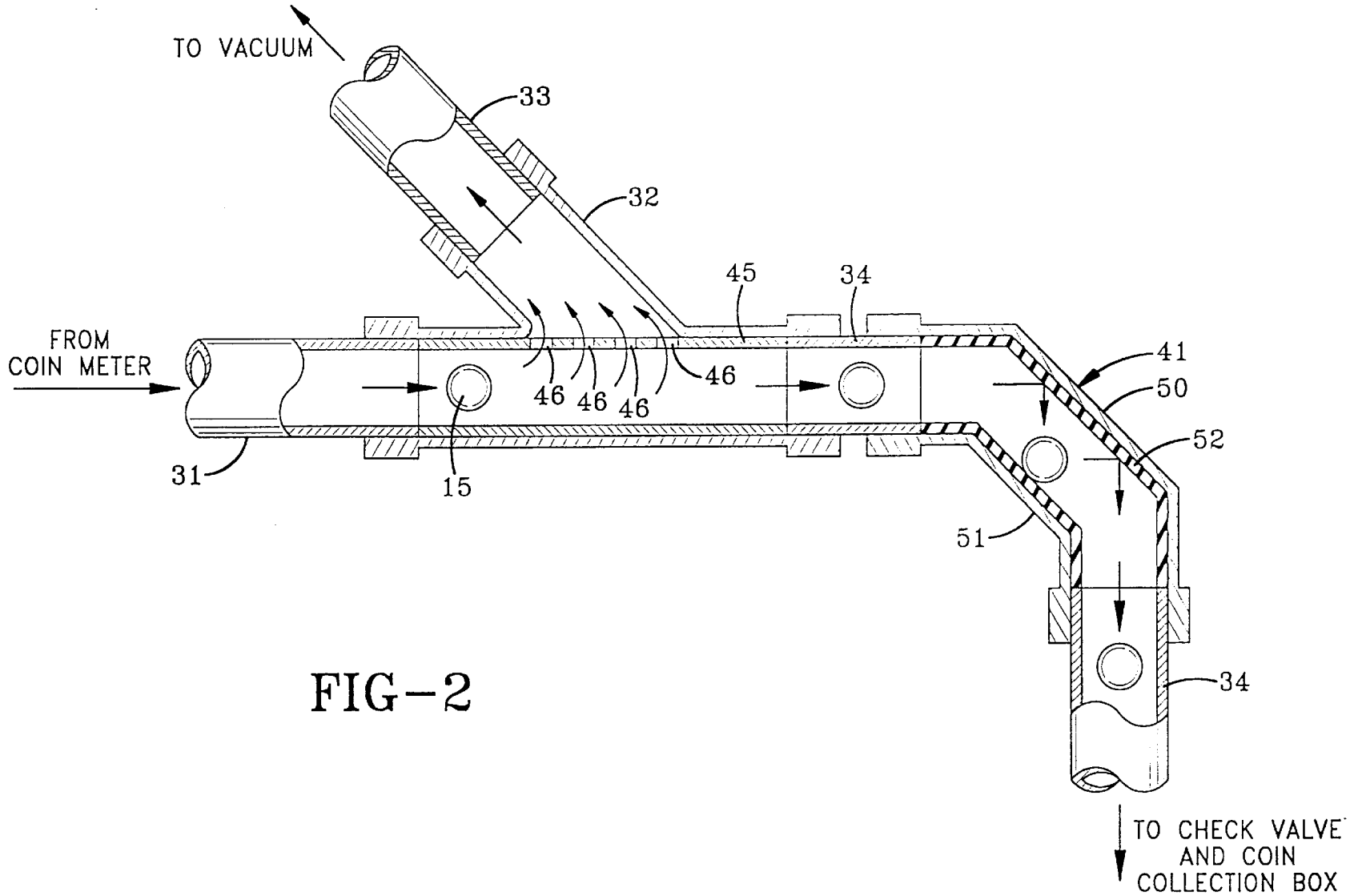
FIG. 2 is a fragmentary sectional view of a portion of the conduit in which both the vacuum supply and coin meter are fluidly connected in a "Y" manner to the coin collection box and where a decelerating elbow is used just downstream of the "Y"

In accordance with one of the main features of the invention, when the above-described vacuum is formed, the first coin (the coin that actuated the system) and all coins thereafter within a predetermined period of time are accelerated through conduit 31 so as to reach a speed sufficient enough to pass through "Y" 32 and make contact with deceleration means such as internally rubber coated elbow 41 as shown in FIGS. 1–2. After such contact is made, the coins are decelerated and allowed to drop within third conduit 34 to check valve 40. At this time, the check valve 40 is in a closed position due to the vacuum created by pump motor 14. Each of the coins is of sufficient weight to knock open the valve body within the check valve 40 that has closed the conduit. The coins thereby pass through check valve 40 and drop into coin collection box 12. As soon as these coins have passed through check valve 40, the vacuum as created by pump motor 14 suctions the valve body closed again thereby sealing off the third conduit. As a result of this check valve, the pump motor 14 maybe remotely located away from the coin collection box 12. In addition, the coin collection box 12 is not required to be of a sealed design as in the prior art such as in U.S. Pat. No. 4,757,941.

The design of "Y" 32 as is more clearly shown in FIG. 2 is such that it is connectable to each of first conduit 31, second conduit 33, and third conduit 34. A sleeve 45 is positioned within "Y" 32 so as to direct each of the coins from first conduit 31 through "Y" 32 to third conduit 34. Specifically, sleeve 45 includes a plurality of holes 46 which allow for the creation of the vacuum by pump motor 14, while being of a sufficiently minimal diameter to restrict any of the coins from being suctioned up into pump motor 14. Furthermore in one embodiment, "Y" 32 is of such a design that second conduit 33 enters into the axial line connecting first conduit 31 with third conduit 34 at an angle acute to first conduit 31 such that it would be difficult if not impossible for a rapidly moving coin to make such a turn. In operation, the coins as accelerated by pump motor 14 through first conduit 31 pass through "Y" 32 at a sufficient velocity to continue on into third conduit 34 even though the suction force from the vacuum has made a turn in "Y" 32 toward second conduit 33.

Figure 6:
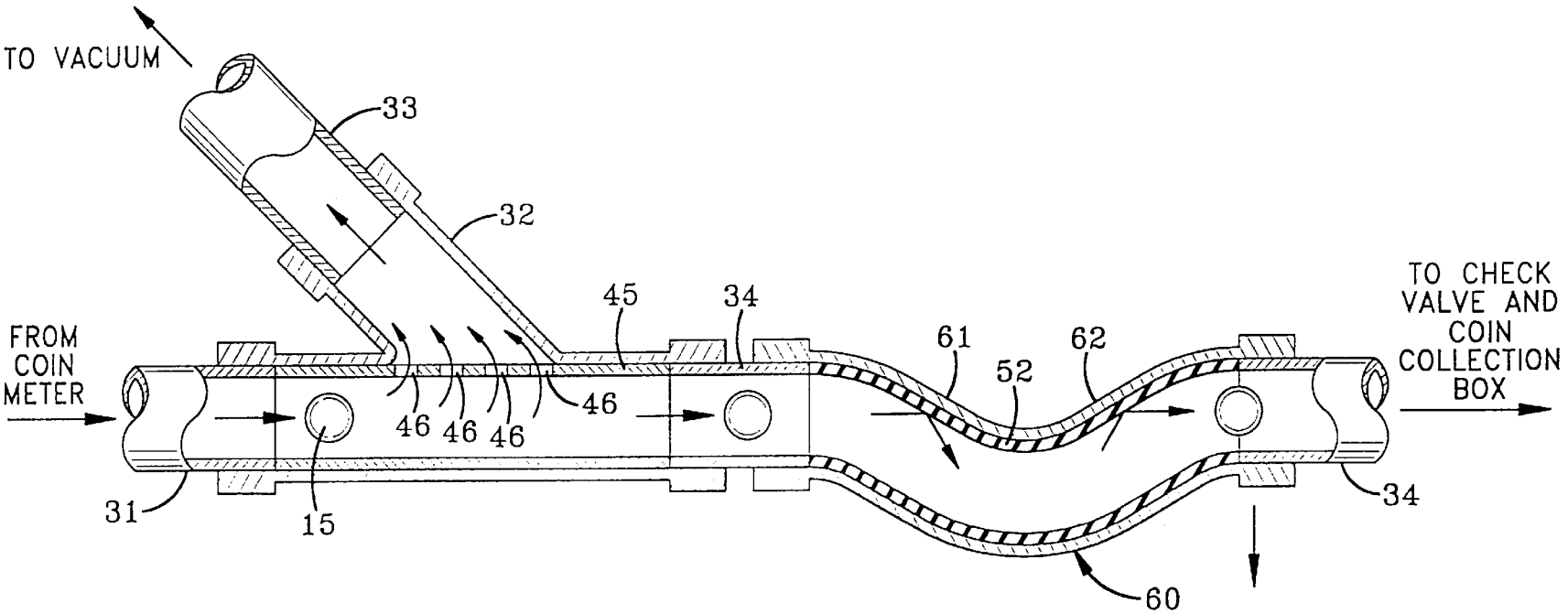
FIG. 6 is a fragmentary sectional view of another embodiment where a jog in the conduit with a rubber coating therein serves to decelerate the coins.

In accordance with another of the main features of the invention, the deceleration means is any combination of an interiorly coated fitting and/or a jogged, bent, or elbow fitting (or any similar twist, bend or other impedance that would interfere with the continued axial motion of the coins). Two examples of the deceleration means are the elbow 41 of FIGS. 1–2 and the jogged pipe 60 as shown in FIG. 6, both of which are typically positioned just downstream from "Y" 32 so as to optimally receive the accelerated coins. These "Y" and deceleration means may be positioned anywhere between the coin meters and the collection box and in any orientation such as horizontal, vertical, diagonal or otherwise.

As shown in FIG. 2, the deceleration means is an elbow 41. One such configuration is shown in FIGS. 1–2. Specifically, first conduit 31 is of a generally horizontal nature as it enters into "Y" 32. Elbow 41 in its most preferred embodiment turns the angle of the coins from this horizontal direction to a vertical direction through two 45° turns. The result of such a construction is that the coins hit outer wall 50 of elbow 41 and bounce downward typically into inner wall 51 and then back out towards outer wall 50 in a zig-zagging type bouncing manner such that the coins significantly slow down or decelerate. After such deceleration, the coins are then allowed to drop through third conduit 34 (which is in a vertical orientation at this point) to the check valve 40 and into coin collection box 12. As indicated above, the weight of each of the coins and the minimal gravitational acceleration is sufficient to open the check valve to allow the coins to pass (even if the vacuum is being supplied thereby pulling the check valve into a temporary closed position).

In accordance with another of the features of the invention, elbow 41 is coated on its interior surface with a rubber coating 52 to further assist the deceleration process.

As shown in FIG. 6, the deceleration means may alternatively be a jog or bend in the conduit such that the center axis of the conduit is altered sufficiently so as to assure that all coins must contact the wall at least once to decelerate the coins 15. The jog or bend may also include a coating 52 therein to further assist in deceleration of the coins and in cushioning the fitting. In the case of the jog 60 shown in FIG. 6, the jog includes two bends 61 and 62 although one or three or more (or a ribbed concept) could be used to perform the deceleration step.

Figure 3:
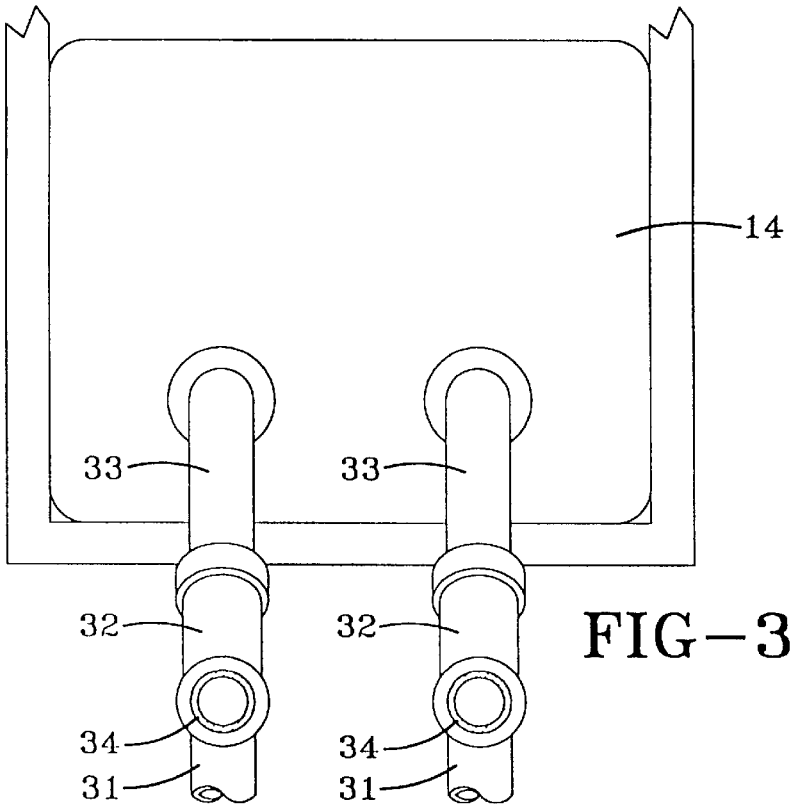
FIG. 3 is a fragmentary end view of the "Y" of each coin passage to the coin collection box.
Figure 7:
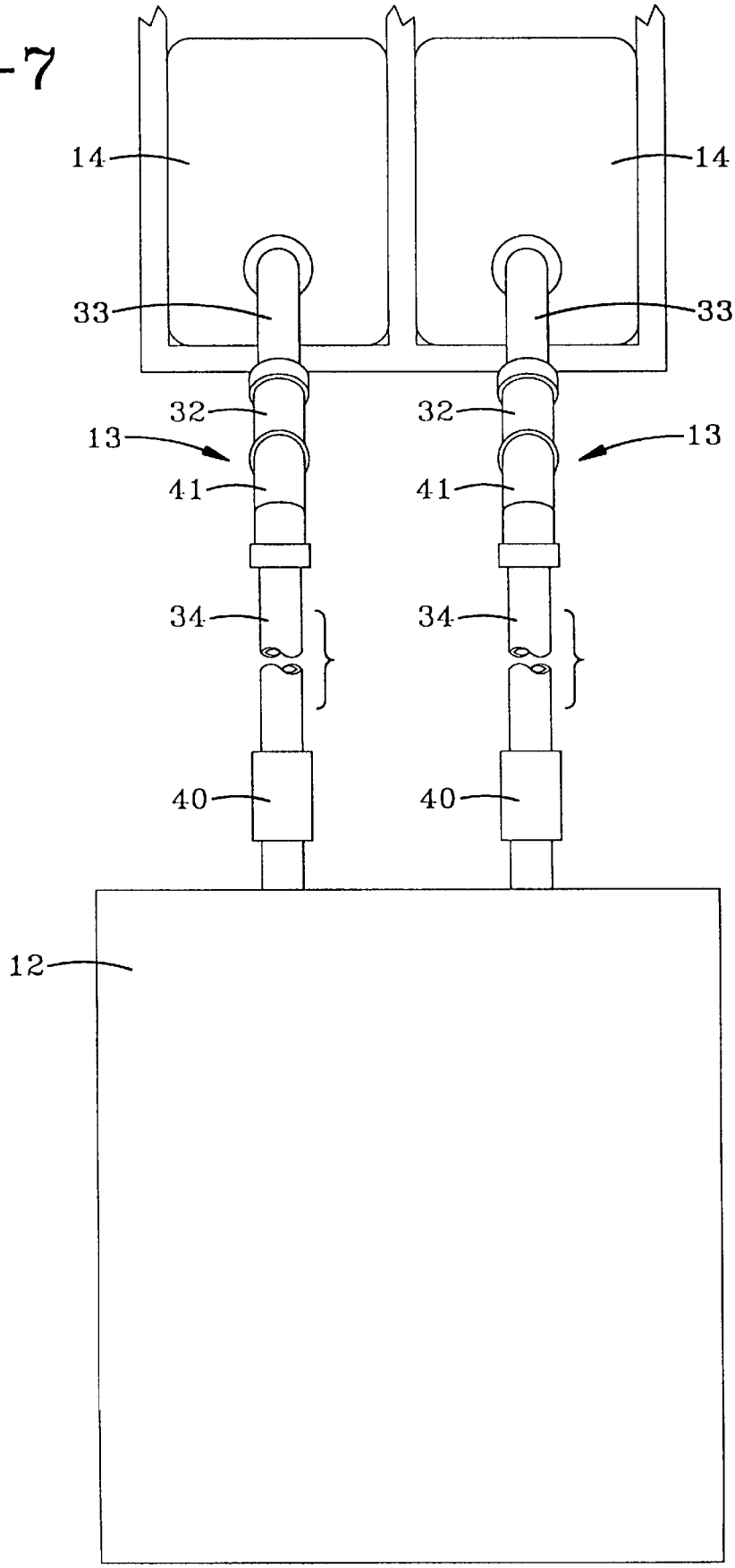
FIG. 7 is a fragmentary end view of the "Y" of an even further embodiment where each coin meter has its own vacuum supply and pump rather than sharing a common pump as in FIG. 3.

In the embodiment shown in FIG. 1, two wash bays 20 are used. Each of these wash bays includes one of the above-described systems. However, only one pump motor 14 and one coin collection box 12 is needed as is shown in FIGS. 1 and 3. Pump motor 14 merely includes multiply outlet ports each of which is connected to a second conduit of one of the coin collection systems 10. Similarly, coin collection box 12 includes multiple inlet ports for the coins from each of the various coin meters 11. Alternatively, as shown in a second embodiment in FIG. 7, individual pumps 14 could be attached to the second conduit of each system thereby allowing the use of smaller pumps that could be more individually spaced and located (while the use of one collection box 12 is still accomplished).

It is critical to note that the check valves 40 are important to a multiple coin meter system that uses one collection box since all of the third conduits empty into the collection box 12. Thus, even is the collection box were sealed, the multiple third conduits emptying therein would provide fluid volume thereby defeating any attempts to create a vacuum in conduits 31 and 33 via a vacuum pump 14 absent this critical check valve 40 which seals the third conduit 34 absent coins dropping from the deceleration means 41 to the collection box 12 (coins cannot travel the other direction).

The improved vacuum coin collection apparatus 10 of the present invention is operated in the following manner. The user of the apparatus selects a bay 20 in which to wash his or her vehicle. The vehicle is then pulled within the bay and parked. The user of the apparatus then deposits a predetermined amount of coins into the coin meter deposit slot 21, which amount depends on the cleaning function or functions he or she desires from the car washing equipment. Specifically, as the first coin is deposited within slot 21, the coin drops into the initial portion of first conduit 31 whereby it passes a sensor 25 of an optical, mechanical, or other mechanism which thereby actuates pump motor 14. Pump motor 14 applies a vacuum to the conduit system 13 for conveying that first coin and all other coins deposited within a predetermined time into the coin meter from the coin meter into the collection box. Thereafter, the additional coins are then deposited and the selection dial 21 is rotated to the appropriate equipment actuation position which automatically actuates the equipment through the various washing and other cycles in a usual manner well known in the art. As is well known in the art, a plurality of discreet equipment actuation positions are available as shown in FIGS. 4 and 5 on face 23 of the coin meter 11 and usually will include a pre-soak, wash, foaming brush, rinse, tire clean, engine clean, and hot wax. As is well known in the art, one may cycle through these various functions at any selected time intervals during the preselected duration of time that is granted by the deposit of coins. Should more time be desired, additional coins are inserted and the coin vacuuming process is begun again.

In one embodiment, the coin vacuum process has a defined period in which the vacuum remains on once the first coin has actuated the system. However, other means of shutting off the vacuum system are contemplated by this invention such as a counter mechanism which counts the quantity of coins that pass by sensors 25 whereby after the last coin has passed, either the vacuum is shutdown at that point or a set time thereafter to allow for all the coins to reach the coin collection box. Another possible system is that the vacuum remains on for as long as the specific cycle or cycles continue that were requested at or near the time of the deposit.

When it is desired to retrieve the coins from the collection box, a door may be opened which was previously secured in a closed position by a lock or other similar security device. The box which is in a location inaccessible to the public, is thereby typically more secure than in the prior art designs where the box was located attached to or adjacent to the coin meters. In addition, because the pump motor 14 is remote from the coin collection box, the coin collection box can be of a substantially reduced size and may be located at just about any location pertaining to the car wash building including within a secured room such as 29 or in a safe or vault or in an underground cavity.

In summary, the improved coin collection apparatus of the invention provides a simple, reliable, user actuated means for automatically conveying coins from the coin meters in the wash bays to a remote secure area of the car wash facility for safe keeping. The coins are conveyed from the meter immediately upon their deposit therein by sensor actuation which actuates the pump motor as well as the associated car washing equipment. The coins are conveyed to the collection box and are quickly and easily removed therefrom by authorized personnel. Both the secured room in which the coin collection box is located and any optional vault storing the box are located in a remote area and thus are protected against theft of the coins. In addition, the separation of the three major components of the coin meters, the coin collection box, and the pump motor allow for each to be more easily stored in better locations for safety, security, and repair.

Accordingly, the vacuum coin collection apparatus of the invention is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved vacuum coin collection apparatus is constructed and used, the characteristics of the construction, and the advantageous, new and useful results obtained; the new and useful structures, devices, elements, arrangements, parts, and combinations are set forth in the appended claims.

What is claimed is:

1. A coin collection apparatus for collecting coins deposited in self-service car washing equipment, the equipment requiring at least a first coin to be deposited; the apparatus including:

at least one coin meter adapted to receive the coins deposited in the self-service car washing equipment;

a coin collection box located remote from the coin meter;

a coin conduit extending generally between the coin meter and the coin collection box;

a vacuum source in fluid communication with the coin conduit;

a coin sensor for sensing the deposit of the first coin into the coin meter; and means for actuating the vacuum source immediately after the coin sensor senses the deposit of the first coin into the coin meter.

2. The coin collection apparatus of claim 1, wherein the vacuum source is fluidly connected to the coin conduit at a location between the coin meter and the coin collection box.

3. The coin collection apparatus of claim 2, further comprising a check valve disposed between the intersection of the vacuum source with the coin conduit and the coin collection box.

4. The coin collection apparatus of claim 3, wherein the vacuum source is disposed remote from the coin collection box.

5. The coin collection apparatus of claim 1, wherein the coin sensor is a mechanically activated sensor.

6. The coin collection apparatus of claim 1, wherein the coin sensor is an optically activated sensor.

7. The coin collection apparatus of claim 1, wherein the coin conduit extends downwardly from the coin collection box.

8. The coin collection apparatus of claim 7, wherein the coin collection box is configured to direct the deposited coin into the downwardly extending coin conduit after the coin trips the coin sensor.

9. The coin collection apparatus of claim 8, wherein the means for actuating the vacuum source actuates the vacuum source while the coin that tripped the sensor is still moving downwardly.

10. A method for conveying coins from a coin meter to a remotely located coin collection box by using a vacuum source to create a vacuum flow through a coin conduit, the vacuum source in communication with a coin sensor; the method comprising the steps of:

sensing when a coin is deposited in the coin meter with the coin sensor;

directing the vacuum flow into the coin conduit immediately after the coin sensor senses the coin; and maintaining the vacuum flow until the coin deposited in the coin meter is moved to the coin collection box.

11. The method of claim 10, further comprising the step of allowing the momentum of the coin to carry it into the coin collection box.

12. The method of claim 11, further comprising the step of impacting the coin against a check valve and causing the check valve to open after the coin has passed the intersection of the vacuum flow and the coin conduit.

* * * * *